US012103644B2

(12) United States Patent
Immonen

(10) Patent No.: US 12,103,644 B2
(45) Date of Patent: Oct. 1, 2024

(54) MOORING DEVICE AND A METHOD FOR OPERATING A MOORING DEVICE

(71) Applicant: 3MAR Oy, Turku (FI)

(72) Inventor: Pauli Immonen, Masku (FI)

(73) Assignee: 3MAR OY, Turku (FI)

( * ) Notice: Subject to any disclaimer, the term of this patent is extended or adjusted under 35 U.S.C. 154(b) by 67 days.

(21) Appl. No.: 17/687,835

(22) Filed: Mar. 7, 2022

(65) Prior Publication Data

US 2022/0289340 A1 Sep. 15, 2022

(30) Foreign Application Priority Data

Mar. 11, 2021 (EP) ..... 21161959

(51) Int. Cl.
*B63B 21/02* (2006.01)
*B63B 21/00* (2006.01)

(52) U.S. Cl.
CPC ..... *B63B 21/02* (2013.01); *B63B 2021/008* (2013.01)

(58) Field of Classification Search
CPC ..... B63B 21/00; B63B 2021/001; B63B 2021/002; B63B 2021/003; B63B 2021/004; B63B 2021/006; B63B 21/02; B63B 2021/008; E02B 3/24
USPC ..... 114/230.1, 230.14, 230.15, 230.16, 114/230.17, 230.19
See application file for complete search history.

(56) References Cited

U.S. PATENT DOCUMENTS 9,387,909 B2 7/2016 Boerleider et al.
9,446,820 B2 9/2016 Boerleider et al.
2006/0087391 A1* 4/2006 Ferro ..... B63B 21/02 335/284

(Continued)

FOREIGN PATENT DOCUMENTS

CN 104249809 A 12/2014
CN 108674582 A 10/2018

(Continued)

OTHER PUBLICATIONS

Canadian Office Action received for CA Application No. 3,150,843 on Aug. 22, 2023, 4 pgs.

(Continued)

*Primary Examiner* — Daniel V Venne
(74) *Attorney, Agent, or Firm* — Merchant & Gould P.C.

(57) ABSTRACT

A mooring device (100) includes a method for operation. The mooring device (100) has an attachment unit (101) including a contact surface (102) for contacting a surface of an object (201) to be attached and at least one magnet for generating a magnetic field through the contact surface (102) to the object (201), a regulator (104) for adjusting the magnetic field generated by the at least one magnet, a telescopic arm (105) pivotally attached to the attachment unit (101), a first hydraulic cylinder (106) and a second hydraulic cylinder (107) attached to the telescopic arm (105), and a monitor for monitoring linear displacements of the first hydraulic cylinder (106) and the second hydraulic cylinder (107). The regulator (104) is configured, based on the linear displacements, to adjust the magnetic field so that an attachment point on the surface of the object (201) can be changed.

13 Claims, 2 Drawing Sheets

(56) References Cited

U.S. PATENT DOCUMENTS

| | | | | |
|---|---|---|---|---|
| 2007/0084395 | A1* | 4/2007 | Hamilton | B63B 21/02 114/230.1 |
| 2012/0305728 | A1* | 12/2012 | Gravendeel | A63B 27/00 248/309.4 |
| 2015/0047545 | A1* | 2/2015 | Boerleider | B63B 21/02 114/230.15 |
| 2015/0197315 | A1* | 7/2015 | Boerleider | B63B 21/02 114/230.1 |

FOREIGN PATENT DOCUMENTS

| | | | |
|---|---|---|---|
| CN | 110427038 | A | 11/2019 |
| CN | 110525586 | A | 12/2019 |
| CN | 210707801 | U | 6/2020 |
| JP | H07117788 | A | 5/1995 |
| KR | 20170000778 | U | 3/2017 |
| KR | 20170029209 | A | 3/2017 |
| KR | 101903683 | B1 | 10/2018 |
| KR | 20200031428 | A | 3/2020 |
| NL | 8600973 | A | 11/1987 |
| RU | 2734644 | C1 | 10/2020 |
| WO | 2010/053368 | A1 | 5/2010 |
| WO | 2017/125153 | A1 | 7/2017 |
| WO | 2018/117817 | A1 | 6/2018 |
| WO | 2019/071665 | A1 | 4/2019 |
| WO | 2019/158710 | A1 | 8/2019 |
| WO | 2020/187887 | A1 | 9/2020 |

OTHER PUBLICATIONS

European Search Report for EP Application No. 21161959 mailed Sep. 10, 2021 (2 pages).

* cited by examiner

MOORING DEVICE AND A METHOD FOR OPERATING A MOORING DEVICE

CROSS-REFERENCE TO RELATED APPLICATIONS

This application claims priority benefit of Serial No. 21161959.8, filed Mar. 11, 2021 in Europe, and which application is incorporated herein by reference. To the extent appropriate, a claim of priority is made to the above-disclosed application.

TECHNICAL FIELD OF THE INVENTION

The present invention relates to a mooring device and a method for operating a mooring device according to the preambles of the appended independent claims. The present invention also relates to a vessel and a mooring structure that incorporate such a mooring device.

BACKGROUND OF THE INVENTION

Various devices are known in the prior art for mooring a vessel such as a ship or a boat to a quay, a wharf, a jetty, a pier, or other mooring structure. The vessel is secured to the mooring structure to forestall free movement of the vessel on the water.

One group of mooring devices uses magnets for detachably attaching a vessel to a mooring structure. The used magnets are typically electromagnets, which require an electric current to generate and maintain a magnetic field. The strength of the magnetic field can be adjusted by controlling the amount of the electric current supplied to the electromagnet.

An example of a known magnetic mooring device comprises a frame and an electromagnet mounted in the frame. The frame is attached to a movable arm that is supported by a base to a mooring structure. A vessel is moored to the mooring structure by first moving the frame with the movable arm into contact with a hull of the vessel and then by generating a magnetic field with the electromagnet whereby the frame attaches to the hull. When the frame is attached to the hull, the movable arm is allowed to move in response to movements of the vessel due to wind and wave action, and due to loading and unloading of the vessel.

A problem associated with the known magnetic mooring device is that it can only be used in situations where the movements of the vessel remain small. The allowed movements of the vessel are limited by the reach of the movable arm. If the vessel moves outside the reach of the movable arm, the mooring device is detached from the vessel.

OBJECTIVES OF THE INVENTION

It is the main objective of the present invention to reduce or even eliminate the prior art problems presented above.

It is an objective of the present invention to provide a mooring device and a method for operating a mooring device. In more detail, it is an objective of the invention to provide a mooring device and a method for its operation that enable to moor a vessel to a mooring structure and allow large movements of the moored vessel. It is a further objective of the present invention to provide a mooring device and a method for its operation that can be easily used and implemented.

In order to realise the above-mentioned objectives, the device and method according to the invention are characterised by what is presented in the characterising portions of the appended independent claims. Advantageous embodiments of the invention are described in the dependent claims.

DESCRIPTION OF THE INVENTION

A mooring device according to the invention comprises an attachment unit that comprises a contact surface for contacting a surface of an object to be attached and at least one magnet for generating a magnetic field through the contact surface to the object, means for adjusting the magnetic field generated by the at least one magnet, a telescopic arm pivotally attached to the attachment unit, a first hydraulic cylinder and a second hydraulic cylinder attached to the telescopic arm, and means for monitoring linear displacements of the first hydraulic cylinder and the second hydraulic cylinder, wherein the adjusting means is configured, based on the linear displacements, to adjust the magnetic field so that an attachment point on the surface of the object can be changed.

The mooring device according to the invention is a magnetic mooring device wherein the attachment to an object is achieved by using the magnet(s), which produce a magnetic holding force. The mooring device is used for mooring a vessel such as a ship or a boat to a mooring structure such as a quay, a wharf, a jetty or a pier. The mooring device can be mounted to a vessel whereby the object to be attached is a mooring structure, or the mooring device can be mounted to a mooring structure whereby the object to be attached is a vessel.

The mooring device according to the invention can detachably attach to an object with the attachment unit. The attachment is achieved by arranging the contact surface in contact with a surface of the object, and then by generating with the at least one magnet a magnetic field through the contact surface to the object. The contact surface can have a shape similar to that of an attachment point on the surface of the object. Preferably, the contact surface is essentially planar.

The attachment unit can comprise one magnet or a plurality of magnets. The attachment unit may comprise a housing inside which the magnet(s) is(are) arranged. The magnet can be an electromagnet or a bi-stable permanent magnet. An electromagnet is a type of magnet in which the magnetic field is produced by an electric current supplied to the magnet. The means for adjusting the magnetic field may comprise a power source for supplying an electric current to the magnet and a control unit for controlling the amount of the supplied electric current to obtain a desired magnetic field. A bi-stable permanent magnet is a type of magnet having two stable states in which the magnet can remain without using energy. One state corresponds to the magnet's ON state, and the other state corresponds to the magnet's OFF state. The bi-stable permanent magnet comprises a movable element that can be moved between two positions corresponding the two stable states. The movable element comprises a permanent magnet for generating a magnetic field, which can be conveyed to the object when the bi-stable permanent magnet is in the ON state. The switching between the stable states can be controlled electrically, pneumatically or hydraulically. The means for adjusting the magnetic field may comprise an electrical control unit for electrically switching the state of the bi-stable permanent magnet, a pneumatic control unit for pneumatically switching the state of the bi-stable permanent magnet, or a hydraulic control unit for hydraulically switching the state of the bi-stable permanent magnet.

The telescopic arm and the first and second hydraulic cylinders are used for moving the attachment unit. A first end of the telescopic arm is pivotally attached to the attachment unit in such a manner that the attachment unit can pivot in at least one, preferably in at least two directions. A second end of the telescopic arm can be pivotally attached to a vessel or a mooring structure. The telescopic arm comprises an outer arm and an inner arm that is located partly inside the outer arm. The inner arm is arranged to be moveable relative to the outer arm in the longitudinal direction of the telescopic arm so that the length of the telescopic arm can be changed. The inner arm can be moved relative to the outer arm by using a third hydraulic cylinder. First ends of the first and second hydraulic cylinders are pivotally attached to the outer arm of the telescopic arm. The first and second hydraulic cylinders can be arranged in such a manner that they can rotate the telescopic arm in essentially perpendicular directions. Second ends of the first and second hydraulic cylinders can be pivotally attached to a vessel or a mooring structure. The mooring device may comprise a base to which the second ends of the telescopic arm, the first hydraulic cylinder and the second hydraulic cylinder are pivotally attached. The base can be attached to a vessel or a mooring structure. When the attachment unit is attached to the object, the first and second hydraulic cylinders are arranged in a floating mode, which allows the telescopic arm to pivot about its second end. By a floating mode of a hydraulic cylinder is meant that the hydraulic cylinder does not resist motion and allows hydraulic oil to flow in and out of the hydraulic cylinder according to the movements of the hydraulic cylinder. When the attachment unit is attached to the object, the telescopic arm is preferably fixed so that its length does not change.

The mooring device according to the invention comprises means for monitoring linear displacements of the first hydraulic cylinder and the second hydraulic cylinder. By the linear displacement of a hydraulic cylinder is meant a change in the length of the hydraulic cylinder relative to a reference position (length) of the hydraulic cylinder. The reference position is preferably a half-retracted position of the hydraulic cylinder. The linear displacements of the first and second hydraulic cylinders are preferably monitored continuously or at predetermined time intervals. When the attachment unit is attached to the object, the linear displacements of the first and second hydraulic cylinders provide information on the relative movement between the mooring device and the object.

In the mooring device according to the invention the means for adjusting the magnetic field generated by the at least one magnet is configured, based on the linear displacements of the first hydraulic cylinder and the second hydraulic cylinder, to adjust the magnetic field so that an attachment point on the surface of the object can be changed. It has been found out that the linear displacements of the first and second hydraulic cylinders are an excellent indication of a need to change the attachment point at the object. The attachment point on the surface of the object is changed by decreasing the magnetic field in such a manner that the attachment unit can slide on the surface of the object, and when the attachment unit has slid to a desired position, increasing the magnetic field so that the attachment unit becomes stationary relative to the object. The first and second hydraulic cylinders can be used to facilitate the sliding of the attachment unit from one attachment point to another on the surface of the object. The length of the telescopic arm can also be adjusted to facilitate the sliding of the attachment unit. This is achieved by moving, with the third hydraulic cylinder, the inner arm relative to the outer arm.

The mooring device according to the invention can be operated as follows. First, the contact surface of the attachment unit is arranged in contact with a surface of an object to be attached. This is achieved by moving the attachment unit with the telescopic arm and the first and second hydraulic cylinders. Then, the attachment unit is attached to the object by generating, with the at least one magnet, a magnetic field through the contact surface to the object. After the attachment unit has attached to the object, the first and second hydraulic cylinders are arranged in a floating mode and their linear displacements are monitored. If the linear displacements of the first and second hydraulic cylinders indicate large movements of the object, the attachment point on the surface of the object is changed by decreasing the magnetic field so that the attachment unit can slide on the surface of the object, and when the attachment unit has slid to a desired position, increasing the magnetic field so that the attachment unit becomes stationary relative to the object.

An advantage of the mooring device according to the invention is that it enables to moor a vessel to a mooring structure, and it tolerates large movements of the moored vessel, for example, due to wind and wave action, and due to loading and unloading of the vessel. The mooring device according to the invention can tolerate the large movements of the vessel because the attachment point can be changed if needed. Another advantage of the mooring device according to the invention is that it can be easily used and implemented.

According to an embodiment of the invention the adjusting means is configured, when the attachment unit is attached to the object and at least one of the linear displacements exceeds a first threshold value specific to each hydraulic cylinder, to decrease the magnetic field so that the attachment unit can slide on the surface of the object, and when the attachment unit slides on the surface of the object and the linear displacements fall below a second threshold value specific to each hydraulic cylinder, to increase the magnetic field so that the attachment unit becomes stationary relative to the object. The mooring device according to this embodiment enables to change the attachment point on the surface of the object. This is achieved by first decreasing the magnetic field so that the attachment unit can slide on the surface of the object, and then increasing the magnetic field so that the attachment unit becomes stationary relative to the object and is thus attached to a new attachment point. Preferably, the first and second hydraulic cylinders are used to facilitate the sliding of the attachment unit on the surface of the object and are operated so that the linear displacements fall below the second threshold values. The length of the telescopic arm can also be adjusted with the third hydraulic cylinder to facilitate the sliding of the attachment unit. The decisions for decreasing and increasing the magnetic field are dictated by the first threshold values and the second threshold values, respectively. The first threshold values are preferably selected so that there is enough safety margin compared to the maximum operating range of the mooring device. The first threshold value for each hydraulic cylinder is larger than its second threshold value. The first threshold values for the first and second hydraulic cylinders can be the same or different. The second threshold values for the first and second hydraulic cylinders can be the same or different.

According to an embodiment of the invention the monitoring means comprises a first linear displacement sensor installed into the first hydraulic cylinder and a second linear displacement sensor installed into the second hydraulic cylinder. By a linear displacement sensor is meant a device whose output signal represents the distance an object has travelled from a reference point. The linear displacement sensor can also indicate the direction of motion. In the hydraulic cylinder, the linear displacement sensor provides information that indicates the amount of rod extension relative to a reference position. Preferably, the reference position is a half-retracted position of the hydraulic cylinder.

According to an embodiment of the invention the telescopic arm comprises a third hydraulic cylinder, the mooring device comprises means for monitoring a force exerted on the third hydraulic cylinder, and the adjusting means is configured to adjust the magnetic field based on the force. The third hydraulic cylinder is attached between an inner arm and outer arm of the telescopic arm to move the inner arm relative to the outer arm in the longitudinal direction of the telescopic arm so that the length of the telescopic arm can be changed.

According to an embodiment of the invention the adjusting means is configured, when the attachment unit is attached to the object and the force exceeds a third threshold value, to decrease the magnetic field so that the attachment unit detaches from the object. By detaching the attachment unit from the object when the force exceeds the third threshold value, the mooring device can be protected from being damaged.

According to an embodiment of the invention the monitoring means comprises a pressure sensor for measuring a hydraulic pressure in the third hydraulic cylinder. The hydraulic pressure in the third hydraulic cylinder is indicative of the force exerted on the third hydraulic cylinder. An advantage of the hydraulic pressure is that it is easy to measure.

According to an embodiment of the invention the mooring device comprises a shock absorbing element for absorbing shocks exerted on the telescopic arm. The shock absorbing element can be arranged in connection with the first or the second end of the telescopic arm. The shock absorbing element can be, for example, a spring or rubber element.

According to an embodiment of the invention the mooring device comprises means for sensing a contact between the contact surface and the surface of the object. The adjusting means is preferably configured to utilize the information on the contact between the contact surface and the surface of the object in such a manner that the magnetic field is generated after the contact has occurred. The sensing means may comprise a mechanical sensor arm with a spring loading and a sensor attached to the mechanical sensor arm.

According to an embodiment of the invention the magnet is a bi-stable permanent magnet. An advantage of the bi-stable permanent magnet is that the magnet does not require energy when it is on the ON state. In fact, the bi-stable permanent magnet needs energy only for switching the state of the magnet.

The present invention also relates to a vessel that comprises a mooring device according to the invention for mooring the vessel to a mooring structure. The mooring structure can comprise a metal plate to which the attachment unit of the mooring device can be detachably attached.

The present invention also relates a mooring structure that comprises a mooring device according to the invention for mooring a vessel to the mooring structure. The attachment unit of the mooring device can be detachably attached to a hull of the vessel or the vessel can comprise a metal plate to which the attachment unit can be detachably attached.

The present invention also relates to a method for operating a mooring device according to the invention. The method comprises moving the contact surface of the attachment unit into contact with a surface of an object to be attached, attaching to the object by generating, with the at least one magnet, a magnetic field through the contact surface to the object, monitoring linear displacements of the first hydraulic cylinder and the second hydraulic cylinder, and adjusting, based on the linear displacements, the magnetic field so that an attachment point on the surface of the object is changed.

In the method according to the invention, the mooring device is attached to the object with the attachment unit. The attachment is achieved by moving the contact surface into contact with the surface of the object, and then by generating with the at least one magnet the magnetic field through the contact surface to the object. The telescopic arm and the first and second hydraulic cylinders are used for moving the attachment unit. When the attachment unit is attached to the object, the first and second hydraulic cylinders are arranged in a floating mode, which allows the telescopic arm to pivot about its second end. The telescopic arm is preferably fixed so that its length does not change. The mooring device can be mounted to a vessel whereby the object to be attached is a mooring structure, or the mooring device can be mounted to a mooring structure whereby the object to be attached is a vessel.

In the method according to the invention, the linear displacements of the first hydraulic cylinder and the second hydraulic cylinder are monitored. The linear displacements of the first and second hydraulic cylinders are preferably monitored continuously or at predetermined time intervals. The linear displacements of the first and second hydraulic cylinders provide information on the relative movement between the mooring device and the object.

In the method according to the invention, the magnetic field generated by the at least one magnet is adjusted based on the linear displacements of the first hydraulic cylinder and the second hydraulic cylinder so that an attachment point on the surface of the object can be changed. The attachment point on the surface of the object is changed by decreasing the magnetic field in such a manner that the attachment unit can slide on the surface of the object, and when the attachment unit has slid to a desired position, increasing the magnetic field so that the attachment unit becomes stationary relative to the object. The first and second hydraulic cylinders can be used to facilitate the sliding of the attachment unit from one attachment point to another on the surface of the object.

An advantage of the method according to the invention is that it enables to moor a vessel to a mooring structure, and it tolerates large movements of the moored vessel, for example, due to wind and wave action, and due to loading and unloading of the vessel. The large movements of the vessel can be tolerated because the attachment point can be changed if needed. Another advantage of the method according to the invention is that it can be easily used and implemented.

According to an embodiment of the invention the step of adjusting the magnetic field comprises, if at least one of the linear displacements exceeds a first threshold value specific to each hydraulic cylinder, decreasing the magnetic field so that the attachment unit slides on the surface of the object, and if, when the attachment unit slides on the surface of the object, the linear displacements fall below a second threshold value specific to each hydraulic cylinder, increasing the magnetic field so that the attachment unit becomes stationary relative to the object. The attachment point on the surface of the object is changed by first decreasing the magnetic field so that the attachment unit can slide on the surface of the object, and then increasing the magnetic field so that the attachment unit becomes stationary relative to the object and is thus attached to a new attachment point. The decisions for decreasing and increasing the magnetic field are dictated by the first threshold values and the second threshold values, respectively. The first threshold values are preferably selected so that there is enough safety margin compared to the maximum operating range of the mooring device. The first threshold value for each hydraulic cylinder is larger than its second threshold value.

According to an embodiment of the invention the step of adjusting the magnetic field comprises using the first hydraulic cylinder and the second hydraulic cylinder to facilitate the sliding of the attachment unit on the surface of the object. Preferably, the first and second hydraulic cylinders are operated so that the linear displacements fall below the second threshold values. The length of the telescopic arm can also be adjusted with the third hydraulic cylinder to facilitate the sliding of the attachment unit.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

The exemplary embodiments presented in this text and their advantages relate by applicable parts to the device as well as the method according to the invention, even though this is not always separately mentioned.

DETAILED DESCRIPTION OF THE DRAWINGS

Figure 1A:
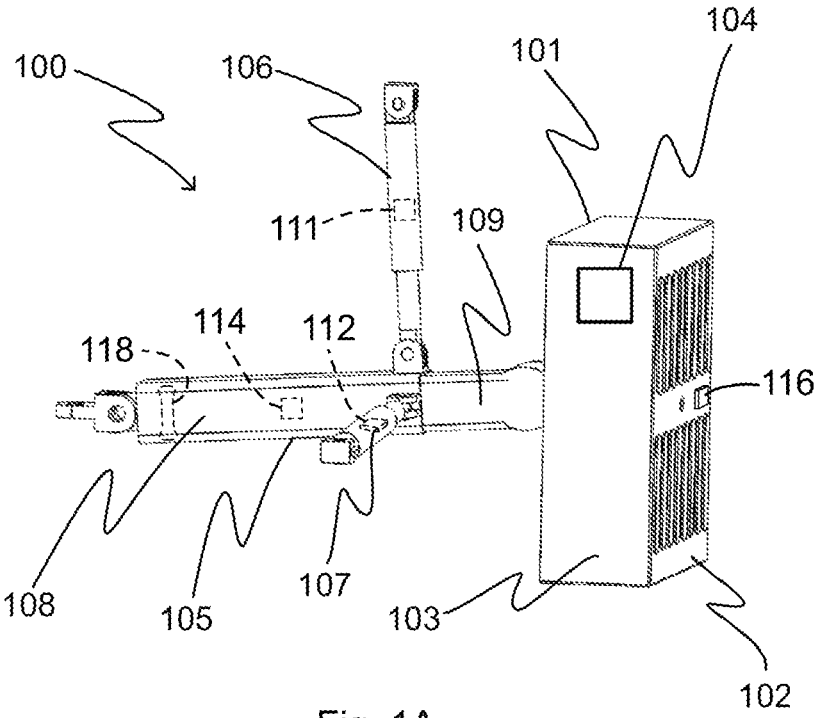
FIGS. 1A-1B illustrate a mooring device according to an embodiment of the invention.
Figure 1B:
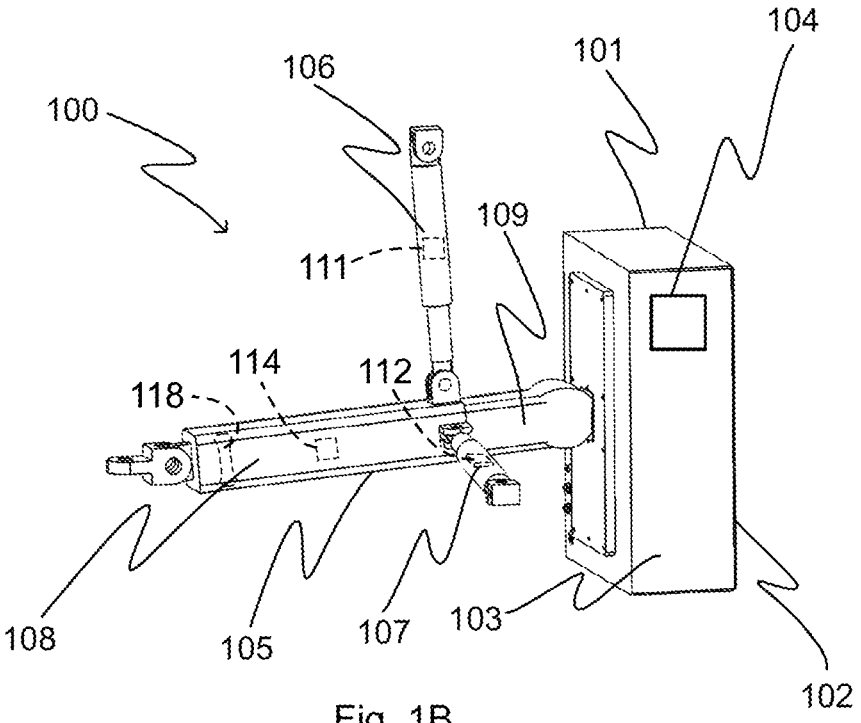

FIGS. 1A-1B illustrate a mooring device according to an embodiment of the invention, viewed from two different directions. The mooring device 100 can be mounted to a vessel or a mooring structure for mooring the vessel to the mooring structure.

The mooring device 100 comprises an attachment unit 101 that comprises a contact surface 102 with a pressure sensor 116 (Such a pressure sensor is conventional and known in the art) for contacting a surface of a metal plate (not shown) that can be attached to the vessel or the mooring structure, and a plurality of magnets (not shown) for generating a magnetic field through the contact surface 102 to the metal plate. The magnets are arranged inside a housing 103 of the attachment unit 101. The mooring device 100 comprises a control unit 104 for adjusting the magnetic field generated by the magnets. The attachment to the metal plate is achieved by arranging the contact surface 102 in contact with a surface of the metal plate, and then by generating with the magnets a magnetic field through the contact surface 102 to the metal plate.

The mooring device 100 comprises a telescopic arm 105 and two hydraulic cylinders 106 and 107 for moving the attachment unit 101. A first end of the telescopic arm 105 is pivotally attached to the attachment unit 101, and a second end of the telescopic arm 105 can be pivotally attached to the vessel or the mooring structure. The telescopic arm 105 comprises an outer arm 108 and an inner arm 109 that is arranged to be moveable relative to the outer arm 108 in the longitudinal direction of the telescopic arm 105 so that the length of the telescopic arm 105 can be adjusted. The inner arm 109 can be moved relative to the outer arm 108 by using a hydraulic cylinder with a shock absorber 118 (Such a shock absorber is conventional and known in the art.). First ends of the hydraulic cylinders 106 and 107 are pivotally attached to the outer arm 108, and second ends of the hydraulic cylinders 106 and 107 can be pivotally attached to the vessel or the mooring structure.

The hydraulic cylinders 106 and 107 comprise linear displacement sensors 111 and 112 (Such a displacement sensors are conventional and known in the art) for measuring linear displacements of the hydraulic cylinders 106 and 107. The linear displacement sensors 111 and 112 measure the amount of rod extension relative to a reference position. When the attachment unit 101 is attached to the metal plate, the linear displacements of the hydraulic cylinders 106 and 107 provide information on the relative movement between the vessel and the mooring structure.

The control unit 104 is configured, based on the linear displacements of the hydraulic cylinders 106 and 107, to adjust the magnetic field generated by the magnets so that an attachment point on the surface of the metal plate can be changed. The attachment point on the surface of the metal plate is changed by decreasing the magnetic field in such a manner that the attachment unit 101 can slide on the surface of the metal plate, and when the attachment unit 101 has slid to a desired position, increasing the magnetic field so that the attachment unit 101 becomes stationary relative to the metal plate. The hydraulic cylinders 106 and 107 are used to facilitate the sliding of the attachment unit 101 from one attachment point to another on the surface of the metal plate.

The hydraulic cylinder of the telescopic arm 105 comprises a pressure sensor 114 for measuring a hydraulic pressure in the hydraulic cylinder (Such a pressure sensor is conventional and known in the art). The hydraulic pressure is indicative of the force exerted on the telescopic arm 105 and it is utilised by the control unit 104 to detach the attachment unit 101 from the metal plate when the hydraulic pressure exceeds a predetermined threshold value so that the mooring device 100 can be protected from being damaged.

Figure 2A:
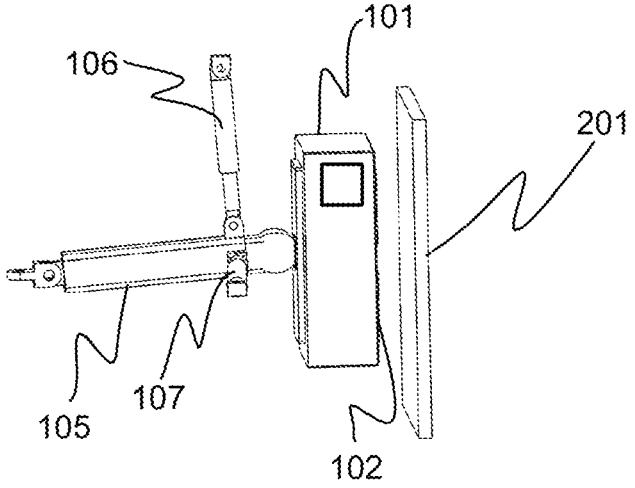
FIGS. 2A-2C illustrate the use of the mooring device according to FIGS. 1A-1B.
Figure 2B:
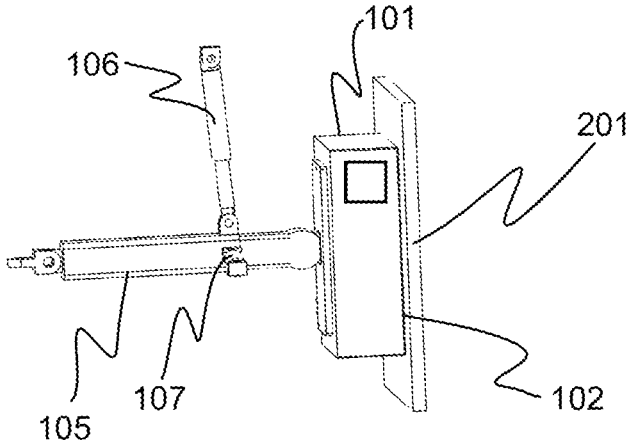
Figure 2C:
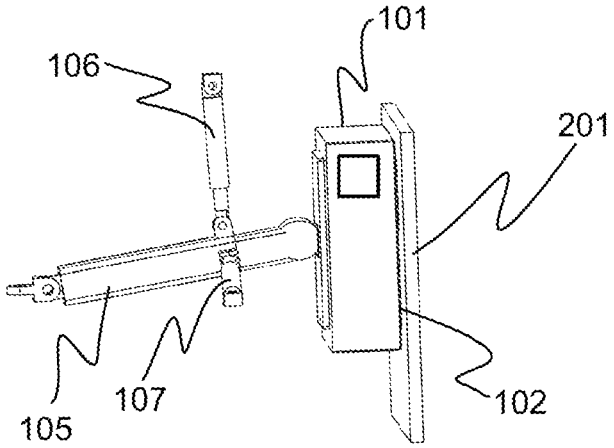

FIGS. 2A-2C illustrate the use of the mooring device according to FIGS. 1A-1B. In FIG. 2A, there is shown a situation where the attachment unit 101 is moved towards a metal plate 201 by using the telescopic arm 105. The attachment unit 101 is moved until the contact surface 102 comes into contact with the surface of the metal plate 201. After the contact, the magnets are adjusted to generate a magnetic field through the contact surface 102 to the metal plate 201, whereby the attachment unit 101 attaches to the metal plate 201. This situation is shown in FIG. 2B.

When the attachment unit 101 is attached to the metal plate 201, the telescopic arm 105 is fixed so that its length does not change and the hydraulic cylinders 106 and 107 are arranged in a floating mode, which allows the telescopic arm 105 to pivot about its second end. When the vessel moves relative to the mooring structure, the linear displacements of the hydraulic cylinders 106 and 107 change. By measuring the linear displacements of the hydraulic cylinders 106 and 107, the need for changing the attachment point on the surface of the metal plate 201 can be identified. The attachment point on the surface of the metal plate 201 is changed by adjusting the magnetic field based on the linear displacements of the hydraulic cylinders 106 and 107 in the following manner. When at least one of the linear displacements exceeds a first threshold value specific to each hydraulic cylinder 106 and 107, the magnetic field is decreased so that the attachment unit 101 can slide on the surface of the metal plate 201. The hydraulic cylinders 106 and 107 are used to facilitate the sliding of the attachment unit 101 on the surface of the metal plate 201. Once the linear displacements fall below a second threshold value specific to each hydraulic cylinder 106 and 107, the magnetic field is increased so that the attachment unit 101 becomes stationary relative to the metal plate 201. The situation where the attachment unit 101 has moved to another attachment point is shown in FIG. 2C.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to restrict the scope of protection of the invention as such.

The invention claimed is:

1. A mooring device, comprising:

an attachment unit that comprises a contact surface for contacting a surface of an object to be attached and at least one magnet for generating a magnetic field through the contact surface to the object, and a control unit for adjusting the magnetic field generated by the at least one magnet, a telescopic arm pivotally attached to the attachment unit, a first hydraulic cylinder and a second hydraulic cylinder attached to the telescopic arm, and means for monitoring linear displacements of the first hydraulic cylinder and the second hydraulic cylinder, wherein the control unit is configured, based on the linear displacements, to adjust the magnetic field so that an attachment point on the surface of the object is changeable;

wherein the mooring device comprises means for sensing a contact between the contact surface and the surface of the object.

2. A mooring device, comprising:

an attachment unit that comprises a contact surface for contacting a surface of an object to be attached and at least one magnet for generating a magnetic field through the contact surface to the object, and a control unit for adjusting the magnetic field generated by the at least one magnet, a telescopic arm pivotally attached to the attachment unit, a first hydraulic cylinder and a second hydraulic cylinder attached to the telescopic arm, and means for monitoring linear displacements of the first hydraulic cylinder and the second hydraulic cylinder, wherein the control unit is configured, based on the linear displacements, to adjust the magnetic field so that an attachment point on the surface of the object is changeable;

wherein the control unit is configured, when the attachment unit is attached to the object and at least one of the linear displacements exceeds a first threshold value specific to each hydraulic cylinder, to decrease the magnetic field so that the attachment unit can slide on the surface of the object, and when the attachment unit slides on the surface of the object and the linear displacements fall below a second threshold value specific to each hydraulic cylinder, to increase the magnetic field so that the attachment unit becomes stationary relative to the object.

3. The mooring device according to claim 1, wherein the means for monitoring comprise a first linear displacement sensor installed into the first hydraulic cylinder and a second linear displacement sensor installed into the second hydraulic cylinder.

4. A mooring device, comprising:

an attachment unit that comprises a contact surface for contacting a surface of an object to be attached and at least one magnet for generating a magnetic field through the contact surface to the object, and a control unit for adjusting the magnetic field generated by the at least one magnet, a telescopic arm pivotally attached to the attachment unit, a first hydraulic cylinder and a second hydraulic cylinder attached to the telescopic arm, and means for monitoring linear displacements of the first hydraulic cylinder and the second hydraulic cylinder, wherein the control unit is configured, based on the linear displacements, to adjust the magnetic field so that an attachment point on the surface of the object is changeable;

wherein the telescopic arm comprises a third hydraulic cylinder, the mooring device comprises means for monitoring a force exerted on the third hydraulic cylinder, and the control unit is configured to adjust the magnetic field based on the force.

5. The mooring device according to claim 4, wherein the control unit is configured, when the attachment unit is attached to the object and the force exceeds a third threshold value, to decrease the magnetic field so that the attachment unit detaches from the object.

6. The mooring device according to claim 4, wherein the means for monitoring comprise a pressure sensor for measuring a hydraulic pressure in the third hydraulic cylinder.

7. The mooring device according to claim 1, wherein the mooring device comprises a shock absorbing element for absorbing shocks exerted on the telescopic arm.

8. The mooring device according to claim 1, wherein the magnet is a bi-stable permanent magnet.

9. A vessel comprising a mooring device according to claim 1 for mooring the vessel to a mooring structure.

10. A mooring structure comprising a mooring device according to claim 1 for mooring a vessel to the mooring structure.

11. A method for operating a mooring device according to claim 1, wherein the method comprises:

moving the contact surface of the attachment unit into contact with a surface of an object to be attached, attaching to the object by generating, with the at least one magnet, a magnetic field through the contact surface to the object, monitoring linear displacements of the first hydraulic cylinder and the second hydraulic cylinder, and adjusting, based on the linear displacements, the magnetic field so that an attachment point on the surface of the object is changed.

12. The method according to claim 11, wherein the step of adjusting the magnetic field comprises, if at least one of the linear displacements exceeds a first threshold value specific to each hydraulic cylinder, decreasing the magnetic field so that the attachment unit slides on the surface of the object, and if, when the attachment unit slides on the surface of the object, the linear displacements fall below a second threshold value specific to each hydraulic cylinder, increasing the magnetic field so that the attachment unit becomes stationary relative to the object.

13. The method according to claim 12, wherein the step of adjusting the magnetic field comprises using the first hydraulic cylinder and the second hydraulic cylinder to facilitate sliding of the attachment unit on the surface of the object.

* * * * *